US005544553A

United States Patent [19]

Galat

[11] Patent Number: 5,544,553

[45] Date of Patent: Aug. 13, 1996

[54] OFF-SET GEARED NUTRUNNER ATTACHMENT

[76] Inventor: Donald E. Galat, 1001 Badder, Troy, Mich. 48083

[21] Appl. No.: 342,236

[22] Filed: Nov. 18, 1994

Related U.S. Application Data

[63] Continuation-in-part of Ser. No. 201,065, Feb. 24, 1994, abandoned.

[51] Int. Cl.[6] ..... B25B 17/00

[52] U.S. Cl. ..... 81/57.3; 81/57.13

[58] Field of Search ..... 81/57.13, 57.14, 81/57.29, 57.3, 58.2

[56] References Cited

U.S. PATENT DOCUMENTS

| | | | |
|---|---|---|---|
| 3,602,071 | 8/1971 | Juhasz | 81/57.3 X |
| 3,604,106 | 9/1971 | Borries | 81/58.2 X |
| 4,171,651 | 10/1979 | Dacunto | 81/57.29 |
| 4,506,567 | 3/1985 | Makhlouf | 81/58.2 X |
| 5,048,377 | 9/1991 | Varis | 81/57.3 X |

*Primary Examiner*—James G. Smith

*Attorney, Agent, or Firm*—Charles W. Chandler

[57] ABSTRACT

An open-ended, off-set geared nutrunner has a housing with an opening providing access to a socket opening in the driving gear, and seating structure mounted around the opening to receive the head of a powered wrench in a non-threaded connection when a driving stud on the wrench has been received in the socket opening.

9 Claims, 2 Drawing Sheets

OFF-SET GEARED NUTRUNNER ATTACHMENT

CROSS-REFERENCE TO RELATED APPLICATION

This application is a continuation-in-part of application Ser. No. 08/201,065 having a filing date of Feb. 24, 1994 for "Offset Geared Nutrunner Attachment".

BACKGROUND OF THE INVENTION

In my aforementioned parent application, I disclosed an offset nutrunner having a housing with a driving gear with a central opening for releasably receiving the powered stud of a pneumatic wrench. Such device provides a special advantage over those types of nutrunners having a housing integrally attached to the power means because the driving gear can be readily mated with wrenches from different manufacturers, whether pneumatic, electric, or even manual.

The wrench head is fastened to the nutrunner housing by a threaded collar attached around the access opening to the driving gear. The wrench is screwed on the collar. This is a logical means for coupling the wrench to the nutrunner attachment because a conventional wrench head usually has an internally threaded opening.

It is difficult to both align the handle of the wrench With the nutrunner attachment attachment and fully tighten the wrench head on the collar. One solution Is to insert spacers between the wrench head and the collar. Once aligned, however, the user frequently welds the two components together to maintain their alignment. However, this type of tool experiences severe industrial use, requiring frequent maintenance. Welded components are usually disposed of rather than repaired.

SUMMARY OF THE INVENTION

The broad purpose of the present invention is to provide an improved nutrunner attachment that can be readily coupled with powered wrenches from different manufacturers using a non-threaded coupling.

The preferred embodiment of the invention provides a nutrunner housing having a cylindrical collar around the opening that receives the wrench head. A ring-shaped seat in the collar seats the head of the wrench when the square driving stud is received in the driving gear. Three socket head set screws then releasably lock the wrench in position so that it can be separated from the nutrunner for repairs. The collar has a cut-out section which aligns the wrench with the nutrunner housing. The two components can be readily separated for repairs or joined together, appropriately aligned.

The preferred embodiment of the invention can be easily assembled, eliminates the necessity for inserting shims at the coupling, eliminates welds and permits the user to readily remove the wrench from the attachment for repairs.

The invention can be used on geared nut runner attachments, where closed or open-ended.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
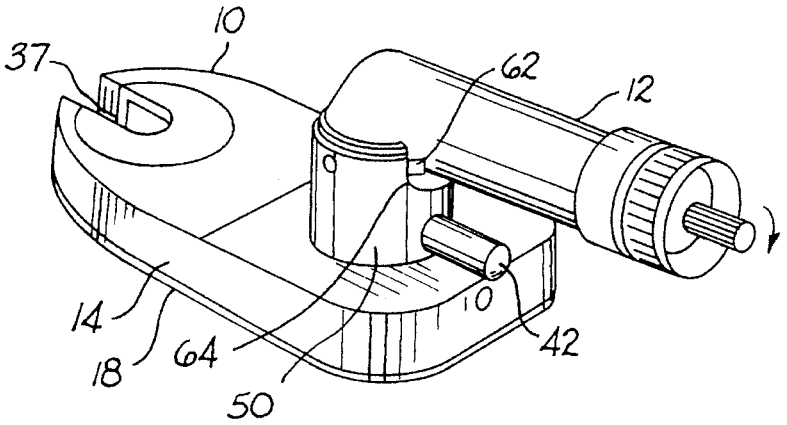
FIG. 1 is a perspective view of a powered wrench coupled to a nutrunner attachment with a preferred non-threaded coupling.

Referring to the drawings, FIG. 1 illustrates a preferred nutrunner 10. Nut runner 10 is illustrated as having an open end for receiving a nut, but the invention can also be used for a closed ended attachment. The head 12 of a commercially-available pneumatic powered wrench is releasably coupled to the nutrunner.

Figure 2:
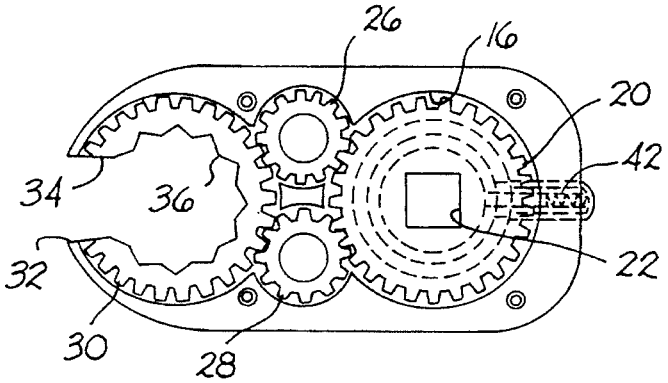
FIG. 2 is a view of the nutrunner with the cap removed to show the internal gear structure.

Referring to FIG. 2, nutrunner 10 includes an elongated housing 14 having an internal gear-receiving chamber 16. A cap 18 covers the bottom open side of the housing to enclose the gears. The gears include a rotatable driving gear 20 having a centrally located square socket opening 22 rotatable about an axis 24. A pair of idler gears 26 and 28 are mounted side-by-side and meshed with the driving gear and in the same plane as driving gear 20. The idler gears are in turn meshed with driven gear 30.

Housing 14 has an end opening 32 for receiving a section of tubing, not shown, bearing a nut, not shown, that is to be loosened. The driven gear has a slot 34 which is aligned with opening 32 of the housing for receiving the tube into a multi-sided internal opening 36. The tube is then moved lengthwise until the nut mates with the sides of opening 36.

The arrangement is such that when driving gear 20 is rotated in the counterclockwise direction, the driven gear is rotated in one direction, and when the driving gear is rotated in the opposite direction, the driven gear is also rotated in its opposite direction.

This structure is described in detail in my co-pending application. Cap 18 has an opening 37 so that the nut can be mated with gear opening 36. The top of gear 30 has a collar 40 for trapping the nut when it is mated in opening 36.

Wrench 12 is then employed to rotate the driving gear to either loosen or tighten the nut.

A spring-loaded detent means 42, mounted on the housing, engages a cut-out section 44 of the driving gear in order to align the driving gear in an appropriate position when slot 34 of the driven gear is aligned with end opening 32 of the housing. The detent prevents the driving gear from reversing more than a partial turn in order to align access slot 34 and end opening 32.

Head 46 of wrench 12 is cylindrical and has a driven rotatable four-sided stud 48 which is received in square socket opening 22 of the driving gear. The stud could take other shapes as long as it is compatible with the shape of the socket opening.

A cylindrical collar 50 having an upper open end 52 is attached to housing 14. The inside of the cylindrical housing has a reduced section forming an annular seat 54 for the cylindrical head of the wrench. The inside diameter at 56 of the collar is slightly larger than the diameter of head 46.

Figure 3:
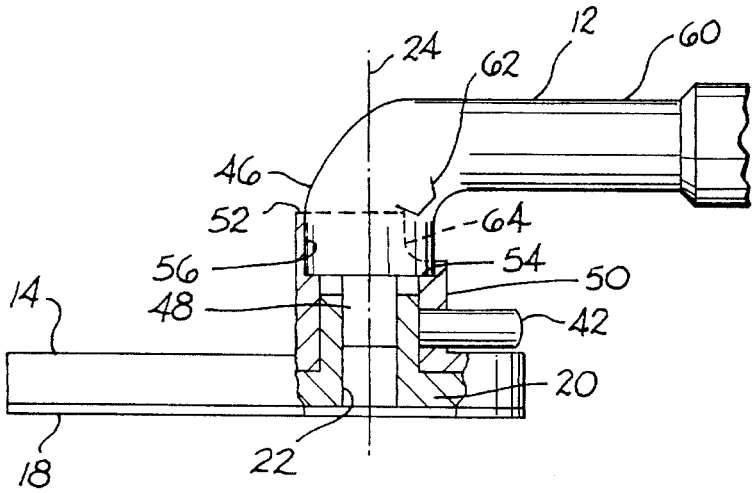
FIG. 3 is an elevational, partially sectional view of the wrench connected to the nutrunner.
Figure 4:
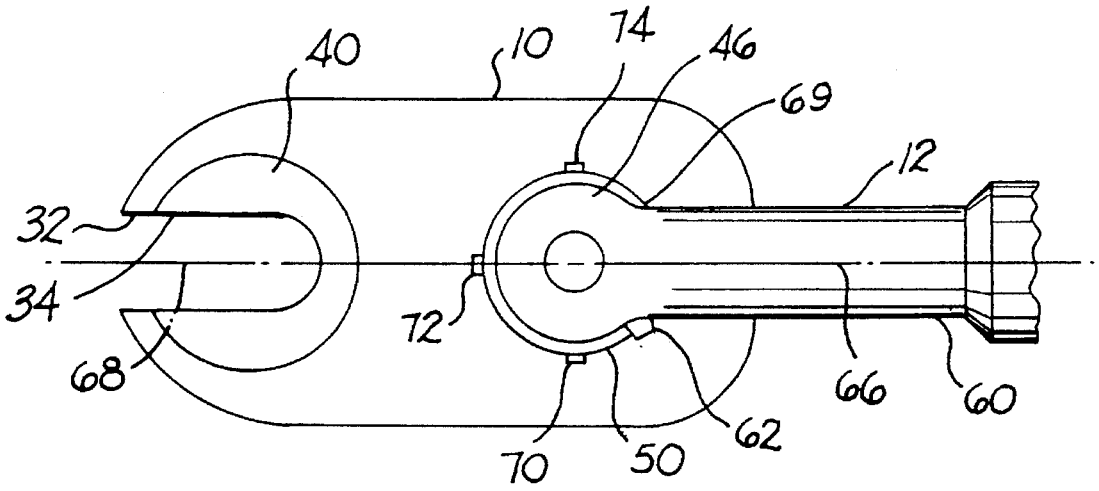
FIG. 4 is a plan view of the wrench connected to the nutrunner.
Figure 5:
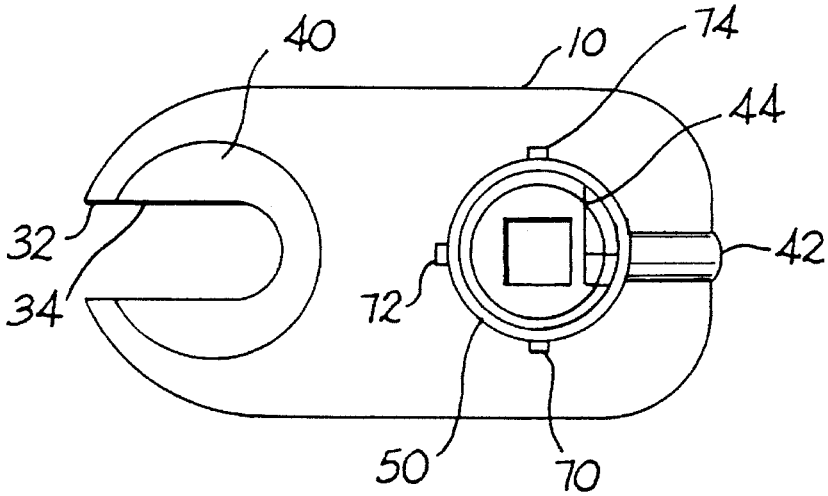
FIG. 5 is a plan view of the nutrunner with the wrench removed.

Referring to FIG. 3, the wrench head has an elongated linear handle 60 which is at right angles to the rotational axis 24 of the stud. Handle 60 carries an abutment 62. Collar 50 has a cut-out portion 64 which engages abutment 62 when the longitudinal axis 66 of handle 60 is aligned with the longitudinal axis 68 of the nutrunner housing and the access opening 32. The handle has abutment 69 for engaging the opposite side of the cut-out opening 64 so that when the head is fully seated on seat 54, abutments 62 and 69 prevent the handle from turning on its seat from its aligned position. In this position, three socket head set screws 70, 72 and 74 carried on the collar at 90° intervals are tightened to lock the handle in position.

In use, wrench head 12 is connected to the nut runner by inserting the stud linearly along axis 24 into the socket opening in the driving gear. The stud may be rotated on the wrench head until it is aligned with the square opening of the driving gear. The head is then seated on seat 54, and fasteners 70, 72 and 74 are tightened to lock the wrench in position. The process is reversed in order to remove the wrench from the nutrunner attachment.

Having described my invention, I claim:

1. An open-ended, off-set geared nut runner with a non-threaded drive coupling, comprising:

a housing having an opening;

a driving gear mounted in the housing for rotation about an axis in either a first direction or in the opposite, second direction, the driving gear having an internal socket opening for releasably receiving a rotatable driving stud;

a substantially annular driven gear having an internal opening having structure engageable with a fastener nut for rotating same, the driven gear being mounted in the housing and being rotatable in either a driving direction or in a reverse direction;

an idler gear mounted in the housing between the driving gear and the driven gear to rotate the driven gear in the driving direction as the driving gear is rotated in a first direction, and to rotate the driven gear in the reverse direction as the driving gear is rotated in the second direction;

the driven gear having a radial opening which can be aligned with the opening in the housing for receiving a tube to a position in the internal opening of the driven gear when the radial opening is aligned with the opening in the housing;

seating structure mounted on the housing adjacent the driving gear for seating the head of a wrench such that a stud carried thereby is received in the socket opening of the driving gear by a generally linear motion along the axis of rotation of the driving gear, and the seating structure includes a collar with a cylindrical opening for receiving the wrench head, and the collar has a cut-out section for mating with the wrench head.

2. A nutrunner as defined in claim 1, including fastener means for locking the wrench in a seated position on the gear housing when the wrench stud has been received in the socket opening in the driving gear.

3. A wrenching attachment as defined in claim 1, in which the internal opening in the driven gear has a diameter less than the diameter of the internal opening of the driven gear so that the radial opening can pass a tube having a diameter less than the diameter of a nut that is to be rotated by the driven gear.

4. A wrenching attachment as defined in claim 1, in which the drive gear and the driven gear are rotatable about spaced parallel axes.

5. A wrenching attachment as defined in claim 1, in which the driven gear has an internal multi-sided structure for engaging a multi-sided fastener nut.

6. A wrenching attachment as defined in claim 1, in which the housing has a socket opening for receiving a drive stud into said multi-sided socket opening.

7. A wrenching attachment as defined in claim 6, in which the socket opening is square.

8. A nutrunner and wrench combination, comprising:

a wrench having a generally cylindrical head, and a rotatable stud projecting beyond the head;

a nutrunner housing having an opening;

a driving gear mounted in the nutrunner housing for rotation, the driving gear having a central socket opening for releasably receiving the stud of the wrench;

a substantially annular driven gear having an internal opening having structure engageable with a fastener nut for rotating same;

an idler gear mounted in the housing between the driving gear and the driven gear to rotate the drive gear in a driving direction as the driving gear is rotated in a first direction, and to rotate the driven gear in a reverse direction as the drive gear is rotated in a second direction;

the driven gear having a radial opening which can be aligned with the opening end in the housing for receiving a tube to a position in he internal opening of the driven gear when the radial opening is aligned with the opening in the nutrunner housing;

seating structure mounted on the housing adjacent the driving gear for seating the head of the wrench such that the stud is received in the socket opening of the driving gear by a generally linear motion along the axis of the rotation of the driving gear, the seating structure including a collar with a cylindrical opening for receiving the wrench head, and the collar having a cut-out section for mating with the wrench head.

9. An open-ended, off-set geared nut runner with a non-threaded drive coupling, comprising:

an elongated housing having a longitudinal axis;

a driving gear mounted in the housing for rotation about an axis in either a first direction or in the opposite, second direction, the driving gear having an internal socket opening for releasably receiving a rotatable driving stud;

a substantially annular driven gear having an internal opening having structure engageable with a fastener nut for rotating same, the driven gear being mounted in the housing and being rotatable in either a driving direction or in a reverse direction;

an idler bear mounted in the housing between the driving gear and the driven gear to rotate the driven gear in the driving direction as the driving gear is rotated in a first direction, and to rotate the driven gear in the reverse direction as the driving gear is rotated in the second direction;

the non-threaded drive coupling comprising seating structure mounted on the housing adjacent the driving gear for seating he head of a wrench having an elongated handle when the handle is aligned with the axis of the housing such that a stud carried thereby is received in the socket opening of the driving gear by a generally linear motion along the axis of rotation of the gear, the seating structure including a collar with cylindrical opening for receiving the wrench head, and the collar having a cut-out section for mating with the wrench head.

* * * * *